US006020793A

United States Patent [19]

Makino et al.

[11] Patent Number: 6,020,793

[45] Date of Patent: Feb. 1, 2000

[54] NON-RECIPROCAL CIRCUIT DEVICE

[75] Inventors: Toshihiro Makino, Mattou; Takashi Kawanami, Ishikawa-ken, both of Japan

[73] Assignee: Murata Manufacturing Co., Ltd., Japan

[21] Appl. No.: 08/900,689

[22] Filed: Jul. 25, 1997

[30] Foreign Application Priority Data

Jul. 26, 1996 [JP] Japan ..... 8-197702
Nov. 6, 1996 [JP] Japan ..... 8-294088

[51] Int. Cl.[7] ..... H01P 1/383

[52] U.S. Cl. ..... 333/1.1; 333/24.2

[58] Field of Search ..... 333/1.1, 24.2

[56] References Cited

U.S. PATENT DOCUMENTS 3,818,381 6/1974 Konishi et al. ..... 333/1.1
3,836,874 9/1974 Maeda et al. ..... 333/1.1

FOREIGN PATENT DOCUMENTS 2671912 7/1992 France ..... 333/1.1
56-24815 3/1981 Japan ..... 333/1.1
57-26912 2/1982 Japan ..... 333/1.1

*Primary Examiner*—Paul Gensler
*Attorney, Agent, or Firm*—Ostrolenk, Faber, Gerb & Soffen, LLP

[57] ABSTRACT

A non-reciprocal circuit device has a plurality of central conductors arranged so as to intersect mutually on a magnetic substance to which a d.c. magnetic field is applied, and matching capacitors connected between the ports of the central conductors and ground. In the non-reciprocal circuit device an inductor is connected between at least one port of the central conductor and the signal-input/output terminal corresponding thereto, to modify the frequency response characteristics thereof.

17 Claims, 8 Drawing Sheets

NON-RECIPROCAL CIRCUIT DEVICE

BACKGROUND OF THE INVENTION

1. Field of the Invention

The present invention relates to non-reciprocal circuit devices for use in a high-frequency band like a microwave band (for example, isolators and circulators), and in particular, to non-reciprocal circuit devices capable of meeting size and price reduction requirements for use in mobile-communication equipment.

2. Description of the Related Art

In general, non-reciprocal circuit devices such as lumped-constant isolators and circulators have characteristics in which the amount of attenuation is extremely small in the direction along which a signal is transmitted, and is extremely large in the reverse direction.

The isolators of this type include a conventional isolator having, for example, a structure as shown in FIG. 7. This isolator includes a magnetic assembly 5 consisting of a permanent magnet 3, three central conductors 51, 52 and 53 and a ferrite member 54, and a resin case 7, both disposed in a closed magnetic circuit formed mainly by a upper yoke 2 and a lower yoke 8. The ports P1 and P2 of the central conductors 51 and 52 are connected to input/output terminals 71 and 72 and matching capacitors Co which are formed in the resin case 7. The port P3 of the central conductor 53 is connected to another matching capacitor Co and a terminal resistor R. One end of each capacitor Co and one end of the terminal resistor R are connected to ground terminals 73.

FIG. 8 shows an equivalent circuit diagram of the above-described isolator. As shown in FIG. 8, the conventional isolator has a structure formed such that the matching capacitors Co are connected to the ports P1, P2 and P3 at the heads of the central conductors 51, 52 and 53, respectively, to form matching circuits, and the terminal resistor R is connected to one port P3. Inductors L have equivalent inductance formed by the ferrite member 54 and the central conductors 51, 52 and 53.

The above-described isolator is employed in the transmission/reception circuit unit of a shared antenna circuit used for mobile-communication apparatuses such as cellular phones and automobile telephones. As shown in FIG. 9, the isolator is used when mounted on the front surface of a mounting base-member 10 where input/output transmission lines 11 and 12, and ground terminals 13 are formed, with a ground electrode formed on almost the entire back surface.

In general, a non-linear characteristic exists in an amplifier built into such a communication apparatus, which causes unnecessary radiation, namely, spurious radiation (a multiple of a fundamental wave, in particular, the second harmonic and the third harmonic). The unnecessary radiation may cause interference, and may also cause a malfunction of a power-amplifying unit in another communication apparatus. Accordingly, the unnecessary radiation is standardized to a constant level or less.

In addition, since the isolator has a bandpass-filter function in its transmission direction, it characteristically has a large amount of attenuation in a frequency band away from its pass band. However, isolators are originally not intended for obtaining attenuation outside their pass band. Thus, the desired amount of attenuation in the frequency bands (particularly, the second and third harmonics of the fundamental wave) where the unnecessary radiation occurs cannot be obtained by the above-described conventional isolator.

Accordingly, this type of conventional communication apparatus employs a method for attenuating the unnecessary radiation with a filter or the like.

In other words, the use of the above conventional isolator requires an unnecessary-radiation prevention filter, and causes a problem in which the cost of components increases due to the prevention filter, and a problem in which the demand for size and price reduction cannot be met.

In addition, in general, the characteristic impedance of input/output transmission lines on a mounting base-member is set to 50 Ω. However, in one modern type of small-sized communication apparatus, for example, a very thin mounting base-member 0.1 to 0.5 mm thick is used, and the width of a transmission line needs to be less than 1 mm in order for the impedance of the transmission line to be 50 Ω. Such a narrow line width cannot reserve a sufficient area for soldering, which makes it difficult to mount the isolator using an automatic mounting apparatus and to obtain sufficient mounting strength (soldering strength). Thus, as shown in FIG. 9, on the mounting base-member 10 that is actually used, the soldering lands 11*a* and 12*a* are formed as wider portions of the transmission lines 11 and 12, to be soldered to the input/output terminals 71 and 72 of the isolator.

In this arrangement, electrode-distribution parasitic capacitors Cp formed by the soldering lands 11*a* and 12*a* greatly shift the characteristic impedance of the transmission lines 11 and 12 from 50 Ω, which makes it impossible to perform impedance matching with the isolator, so that the operating central frequency of the isolator decreases disadvantageously. For countermeasures, the conventional communication apparatus uses an isolator whose operating central frequency is set too high, or employs a complicated and expensive method in which an inductor which resonates in parallel with the electrode-distribution capacitor Cp at the operating central frequency is formed on the mounting base-member 10 so that the value of the electrode-distribution capacitor Cp is canceled. In other words, when the conventional isolator is used, it is necessary to produce various modified isolators to match with the electrode-distribution capacitor Cp, or to form an inductance on the mounting base-member 10 for canceling the value of the electrode-distribution capacitor Cp.

In addition, the input/output impedance of the isolator and the characteristic impedance of the transmission lines on the mounting base-member are generally around 50 Ω. There may be however a case in which the characteristic impedance of the transmission lines is set to a value different from 50 Ω in accordance with an amplifier to be used and the interconnection pattern of the mounting base-member, so it may be demanded that the input/output impedance of the isolator be set to a value different from 50 Ω, for example, 60 Ω.

According to the above-described conventional isolator, a change of its input/output impedance requires a change (re-design) of each component (such as a central conductor and a matching capacitor) included in the non-reciprocal circuit device. Accordingly, various types of components in accordance with the input/output impedance are needed, which disadvantageously increases the cost of components, the costs of component control, and production costs.

To this end, it is a feature of the present invention to provide a non-reciprocal circuit device which is capable of having an increased amount of attenuation outside its pass band, having improved mounting strength, and whose input/output impedance can be easily changed and set to a desired value, which thus contributes to a reduction in size and price.

SUMMARY OF THE INVENTION

According to the present invention, the foregoing feature may be obtained through provision of a non-reciprocal circuit device having a plurality of central conductors arranged so as to intersect mutually on a magnetic substance to which a d.c. magnetic field is applied, and matching capacitors connected between the ports of the central conductors and ground, wherein an inductor is connected between at least one port of the central conductor and the signal-input/output terminal corresponding thereto.

In such a non-reciprocal circuit device, a low-pass filter can be formed by the inductor, the matching capacitor, and the electrode-distribution capacitance of an input/output transmission line on a mounting base-member on which the non-reciprocal circuit device is mounted.

In the above non-reciprocal circuit devices the value of the inductor or the matching capacitor is determined so that the input/output impedance of the non-reciprocal circuit device is set to a desired value.

According to the above features of the present invention, a low-pass filter is formed by an inductor connected between the port of a central conductor and a signal-input/output terminal in a non-reciprocal circuit device, a matching capacitor and the electrode-distribution capacitor of an input/output transmission line on a mounting base-member. Thus, the amount of attenuation outside the pass band can be significantly improved. In other words, by building into the non-reciprocal circuit device the inductor of the low-pass filter, unnecessary radiation can be greatly reduced, which greatly eliminates the need for another unnecessary-radiation prevention filter.

The electrode-distribution capacitance of the transmission line on the mounting base-member is positively used, which thus can eliminate conventionally-required, complicated measures in which the central frequency of the non-reciprocal device is determined in accordance with the electrode-distribution capacitance, or an inductor for canceling the electrode-distribution capacitance is formed on the mounting base-member. A soldering land in which the electrode-distribution capacitance is formed can be used as an area in which easy mounting can be performed and sufficient strength can be obtained, which provides highly reliable mounting and mounting strength.

By changing the above impedance or the value of the above matching capacitor, the input/output impedance of the non-reciprocal circuit device can be easily converted and set to a desired value, without changing a design of the central conductor and so forth.

Accordingly, using a non-reciprocal circuit device of the present invention enables a reduction in size and price, and provides a highly reliable high-performance communication apparatus.

DESCRIPTION OF AN EMBODIMENT OF THE INVENTION

The present invention will be described below based on the attached drawings showing an embodiment thereof.

Figure 1:
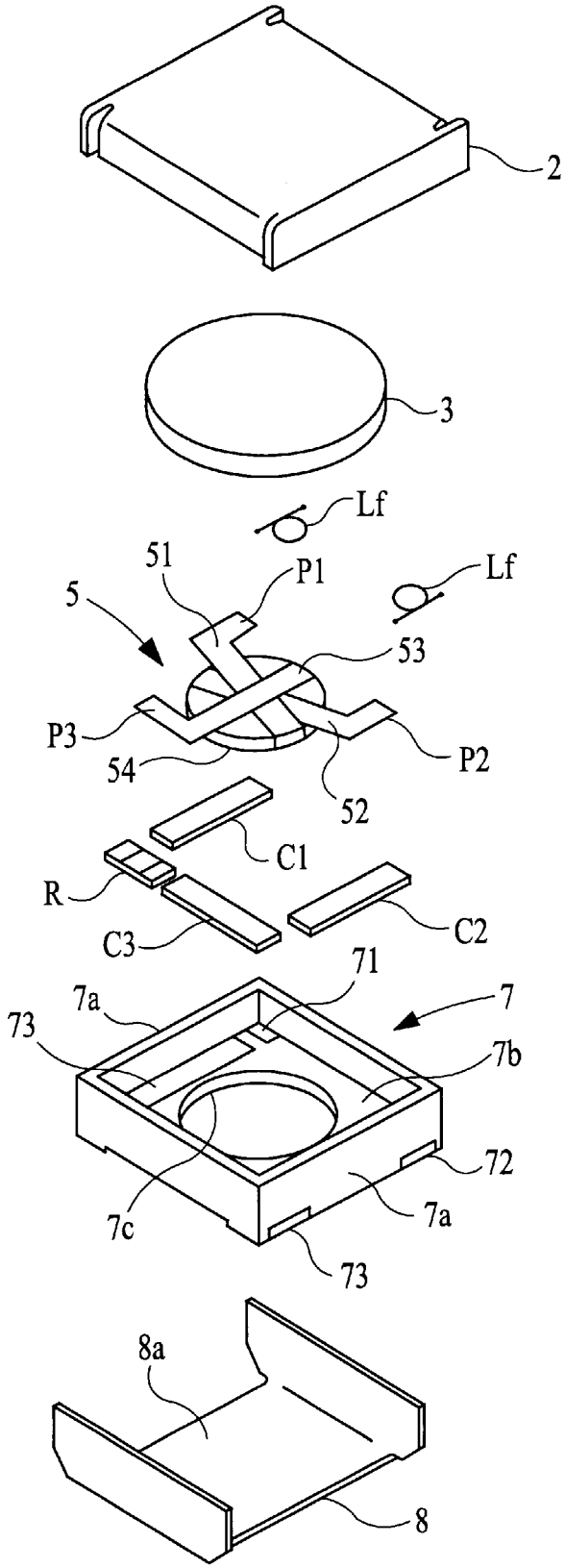
FIG. 1 is an exploded perspective view showing an isolator according to an embodiment of the present invention.
Figure 2:
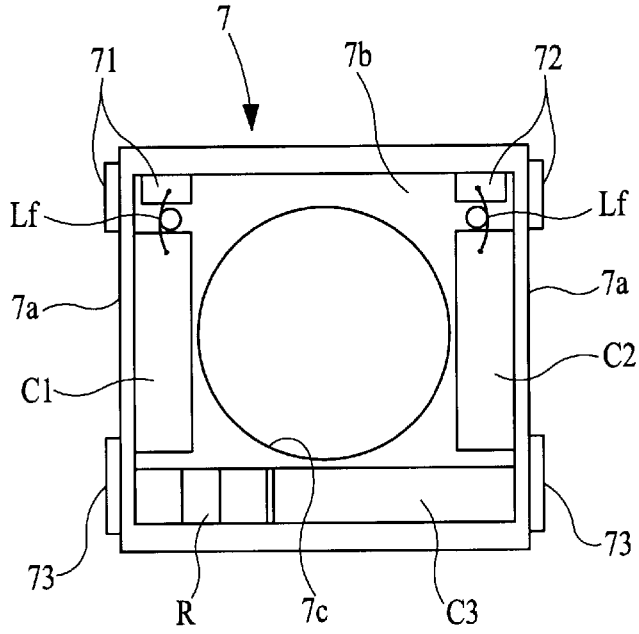
FIG. 2 is a plan view showing the isolator according to the embodiment of the present invention.
Figure 3:
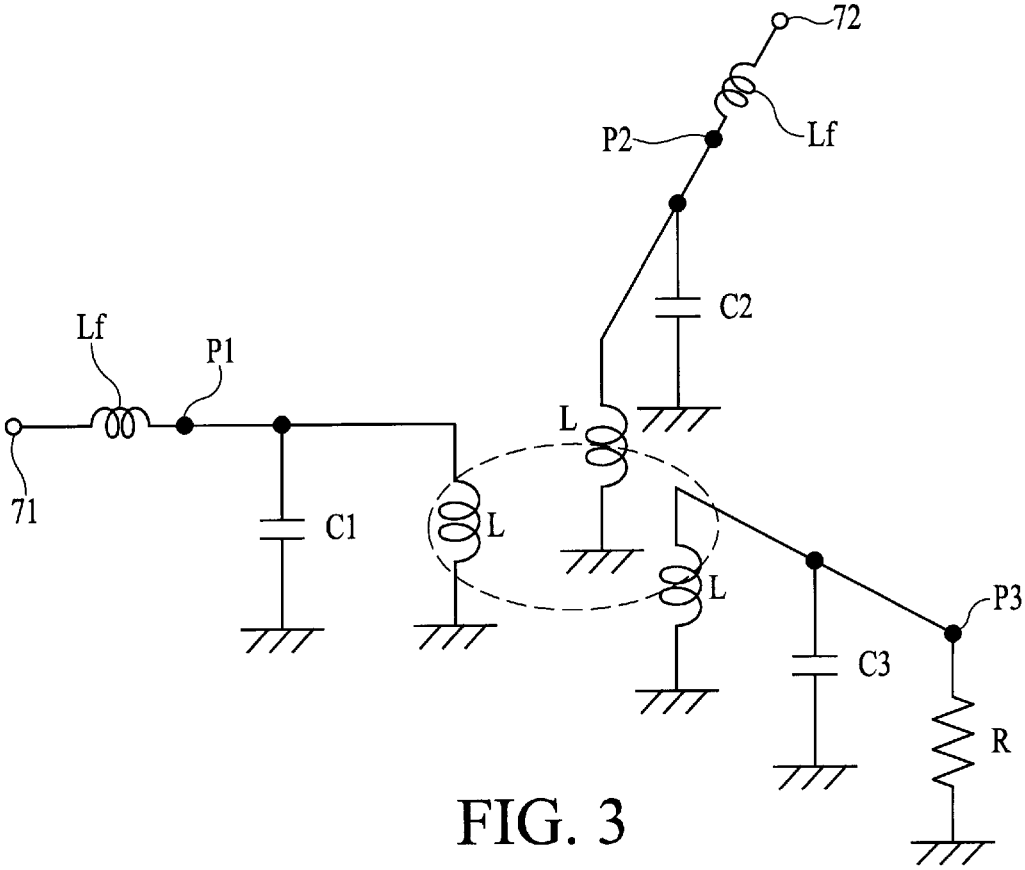
FIG. 3 is an equivalent circuit diagram of the isolator according to the embodiment of the present invention.

The structure of an isolator according to an embodiment of the present invention, and an arrangement thereon are shown in FIGS. 1 to 3. FIG. 1 shows an exploded perspective view of the isolator. FIG. 2 shows a plan view of the isolator, obtained when a magnetic assembly, a permanent magnet and an upper yoke are removed. FIG. 3 shows an equivalent circuit. Capacitors and coils shown in FIGS. 1 and 2 correspond to matching capacitors and inductors shown in FIG. 3, respectively, and are denoted by identical reference numerals.

As shown in FIGS. 1 and 2, the isolator according to this embodiment has a structure formed such that a disk permanent magnet 3 is disposed in a box-shaped upper yoke 2 composed of magnetic metal, a roughly U-shaped lower yoke 8 composed of magnetic metal is mounted to the upper yoke 2 so that a closed magnetic circuit is formed, a resin case 7 is disposed on the bottom face 8*a* in the lower yoke 8, and a magnetic assembly 5, matching capacitors C1 to C3, a terminal resistor R and coils Lf are disposed in the resin case 7.

The magnetic assembly 5 has a structure formed such that the ground portions of three central conductors 51 to 53 abut the bottom surface of a ferrite disk 54, and the three central conductors 51 to 53 are bent onto an insulating sheet (not shown) provided on the top surface of the ferrite disk 54 so as to form an angle of 120 degrees to one another, with ports P1 to P3 as the heads of the central conductors 51 to 53 stretched outward. A d.c. magnetic field is applied from the permanent magnet 3 to the magnetic assembly 5.

The resin case 7 is composed of an electrical insulating member, and is formed such that a bottom wall 7*b* is incorporated with a rectangular side wall 7*a*, and portions of input/output terminals 71 and 72, and ground terminals 73 are embedded in the resin. On the center of the bottom wall 7*b* is formed a through-hole 7*c*, into which the magnetic assembly 5 is inserted. The ground portions of the central conductors 51 to 53 on the bottom surface of the magnetic assembly 5 are connected to the bottom face 8*a* of the lower yoke 8. The input/output terminals 71 and 72 are disposed at both corners of one side of the resin case 7, and the ground terminals 73 are disposed at both corners of another side of the resin case 7, with ends of both terminals exposed on the top face of the bottom wall 7*b*, and other ends of both terminals exposed on the bottom face of the bottom wall 7*b* and on the exterior face of the side wall 7*a*.

On the periphery of the through-hole 7*c* the matching chip capacitors C1 to C3, the chip terminal resistor R, and the coils Lf are disposed. The bottom electrodes of the capacitor C1, C2 or C3 and one-end electrodes of the terminal resistor R are connected to the ground terminals 73, respectively. The ports P1 to P3 of the central conductors 51 to 53 are connected to the top electrodes of the capacitors C1 to C3, and another-end electrodes of the terminal resistor R is connected to the port P3.

Ends of the coils Lf are connected to the ports P1 and P2 of the central conductors 51 and 52, and the other ends are connected to the input/output terminals 71 and 72. Namely, the ports P1 and P2 are connected to the input/output terminals 71 and 72 via the coils Lf, respectively.

In other words, the isolator according to this embodiment is formed such that, as shown in the equivalent circuit diagram of FIG. 3, the matching capacitors C1 to C3 are connected to the ports P1 to P3 which are the heads of the central conductors 51, 52 and 53, the terminal resistor R is connected to the one port P3, and the inductors Lf are connected between the two ports P1, P2 and the input/output ends 71, 72 which are used as signal-input/output terminals. The isolator is used when mounted on the front surface of a mounting base-member 10, similar to the conventional example shown in FIG. 9.

Figure 4:
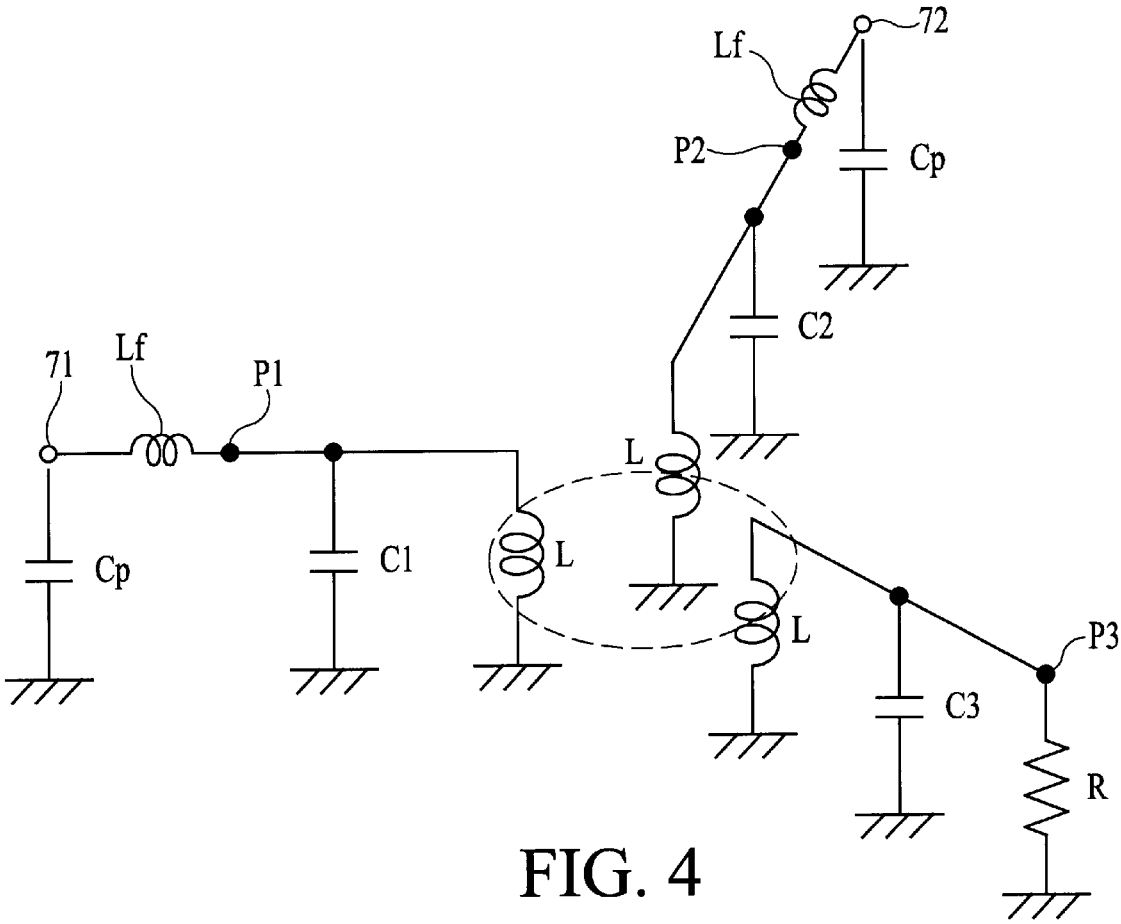
FIG. 4 is an equivalent circuit diagram showing the isolator (according to the embodiment of the present invention) being mounted.
Figure 5:
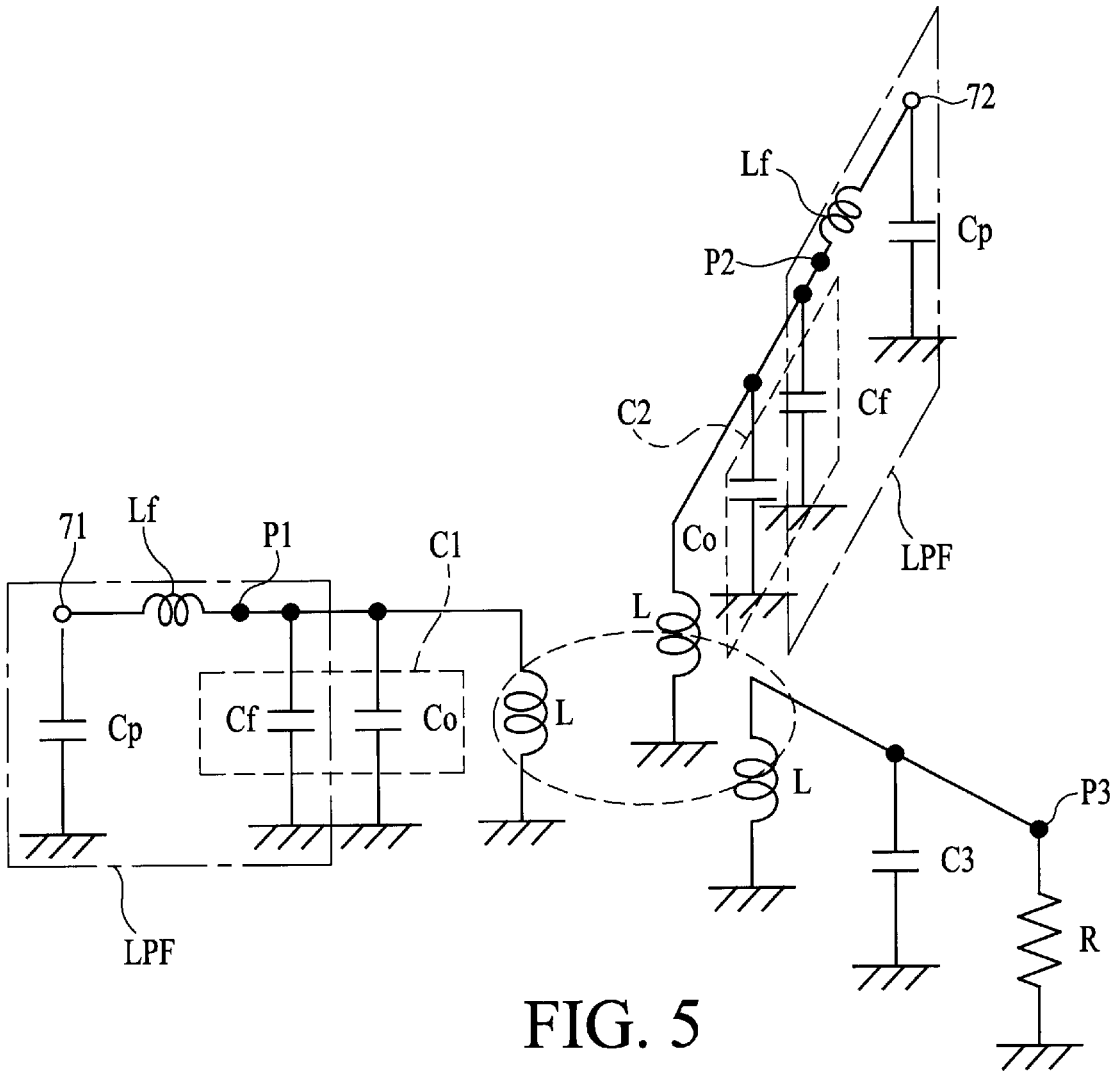
FIG. 5 is an equivalent circuit diagram showing the operation of the isolator (according to the embodiment of the present invention) being mounted.

Next, the operation of the isolator according to this embodiment will be described. FIGS. 4 and 5 show equivalent circuit diagrams, obtained when the isolator according to this embodiment is mounted on the mounting base-member 10. FIG. 5 illustrates the operation (operating principle) of the isolator when mounted on the mounting base-member 10.

Figure 9:
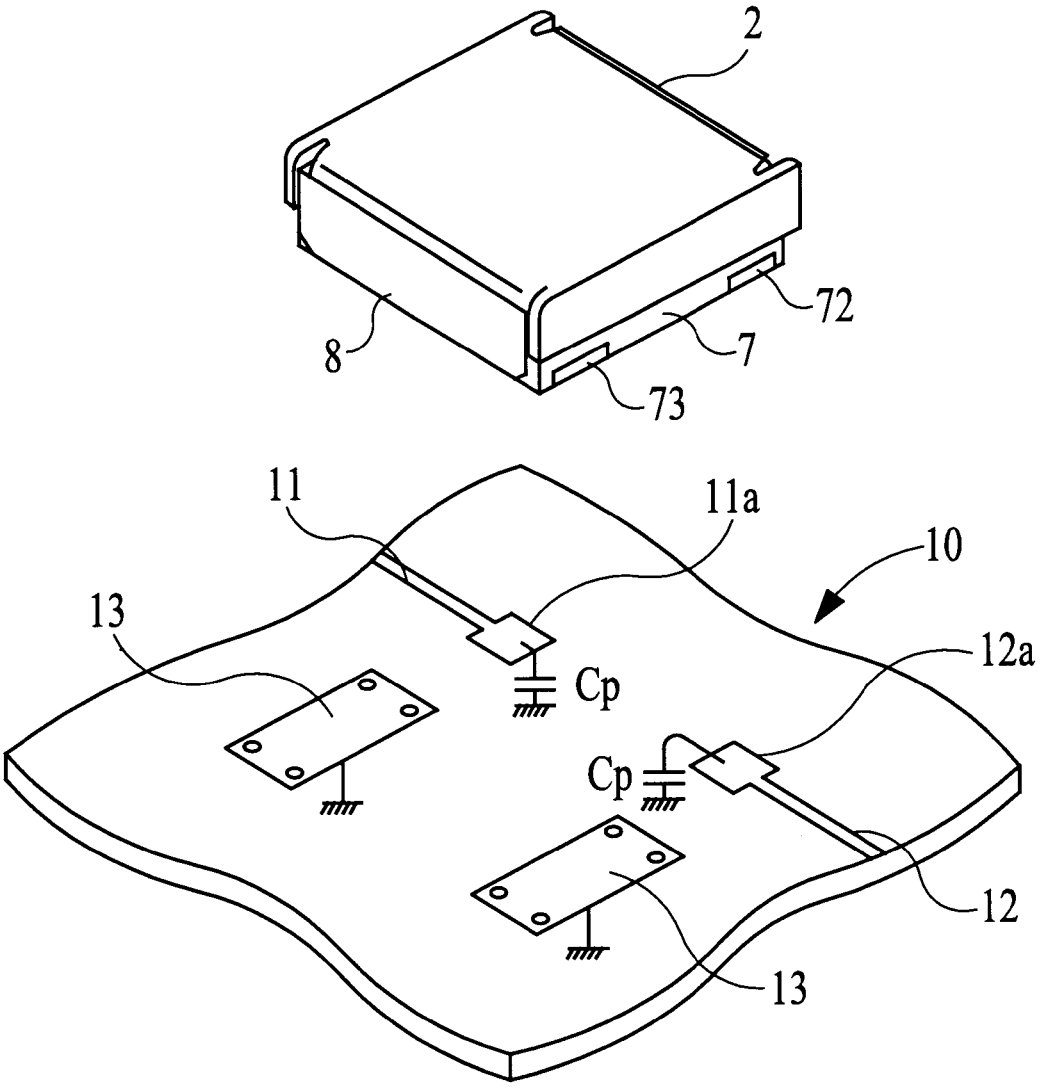
FIG. 9 PRIOR ART
FIG. 9 is a perspective view showing when the conventional isolator is mounted.

As shown in FIGS. 4 and 5, when the isolator according to this embodiment is mounted on the mounting base-member 10 (as shown in FIG. 9), electrode-distribution capacitances Cp parasitically generated on the soldering lands 11*a* and 12*a* of the transmission lines 11 and 12 are connected to the input/output terminals 71 and 72 of the isolator.

In addition, as shown in FIG. 5, in the signal-input/output portions (ports P1 and P2) are formed π-type low-pass filters LPF including the inductors Lf, capacitors Cf as parts of the matching capacitors C1 and C2, and an electrode-distribution capacitor Cp on the mounting base-member.

In other words, the matching capacitor C1 or C2 of the isolator according to this embodiment includes parallel capacitors: the matching capacitor Co functioning as an isolator matching circuit; and the capacitor Cf of the π-type low-pass filters LPF. Namely, the capacitance of the matching capacitor C1 and C2 of the isolator according to this embodiment is set to a value obtained by adding the value of the capacitor Cf to the value of the matching capacitor Co of the conventional isolator. The isolator according to this embodiment, having a microsize, is approximately 7.0 mm wide, 7.0 mm long and 2.5 mm high. For example, in the 1.5-GHz band the value of the capacitor Co is set to approximately 5 pF, and the value of capacitor Cf is set to approximately 2 pF. In the 900-MHz band the value of the capacitor Co is set to approximately 10 pF, the value of the capacitor Cf is set to approximately 3 pF, and the value of the inductor Lf is set to approximately 2 to 3 nH.

The value of the capacitor Cf is set to the capacitance of the electrode-distribution capacitor Cp so that no change occurs in the input/output impedance (normally 50 Ω) of the isolator. By determining the appropriate values of the inductor Lf, the capacitor Cf and the electrode-distribution capacitor Cp, the input/output impedance of the isolator can be changed without decreasing electrical characteristics of the isolator.

For example, by decreasing the value of the inductor Lf, and the values of the capacitor Cf (namely, the matching capacitor C1 or C2) and the electrode-distribution capacitor Cp, the input/output impedance of the isolator can be reduced. In addition, by increasing the value of the inductor Lf without changing the values of the capacitor Cf and the electrode-distribution capacitor Cp, the input/output impedance can be increased.

As described above, the values of the inductor Lf, the capacitor Cf and the electrode-distribution capacitor Cp are properly determined in view of the thickness of the mounting base-member, a frequency to be used, electrical characteristics, load impedance, mounting strength, and so forth.

Figure 6:
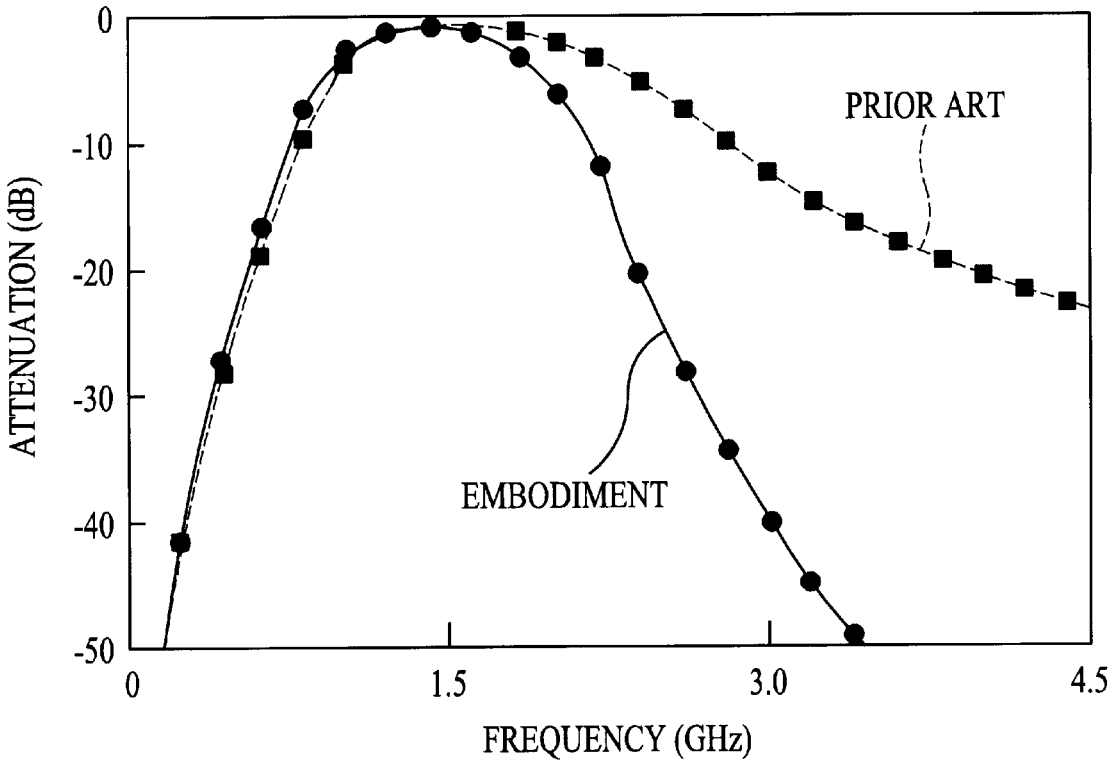
FIG. 6 is a frequency-characteristic chart showing the isolator according to the embodiment of the present invention and a conventional isolator.
Figure 7:
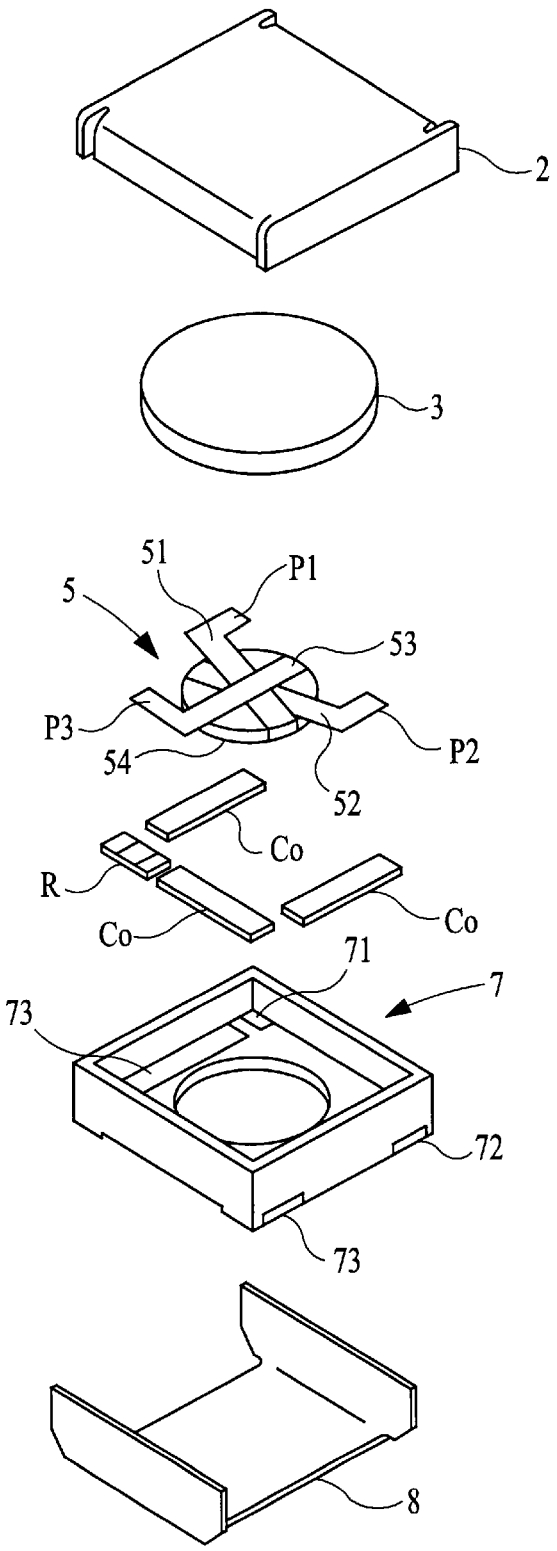
FIG. 7 PRIOR ART
FIG. 7 is an exploded perspective view showing the conventional isolator.
Figure 8:
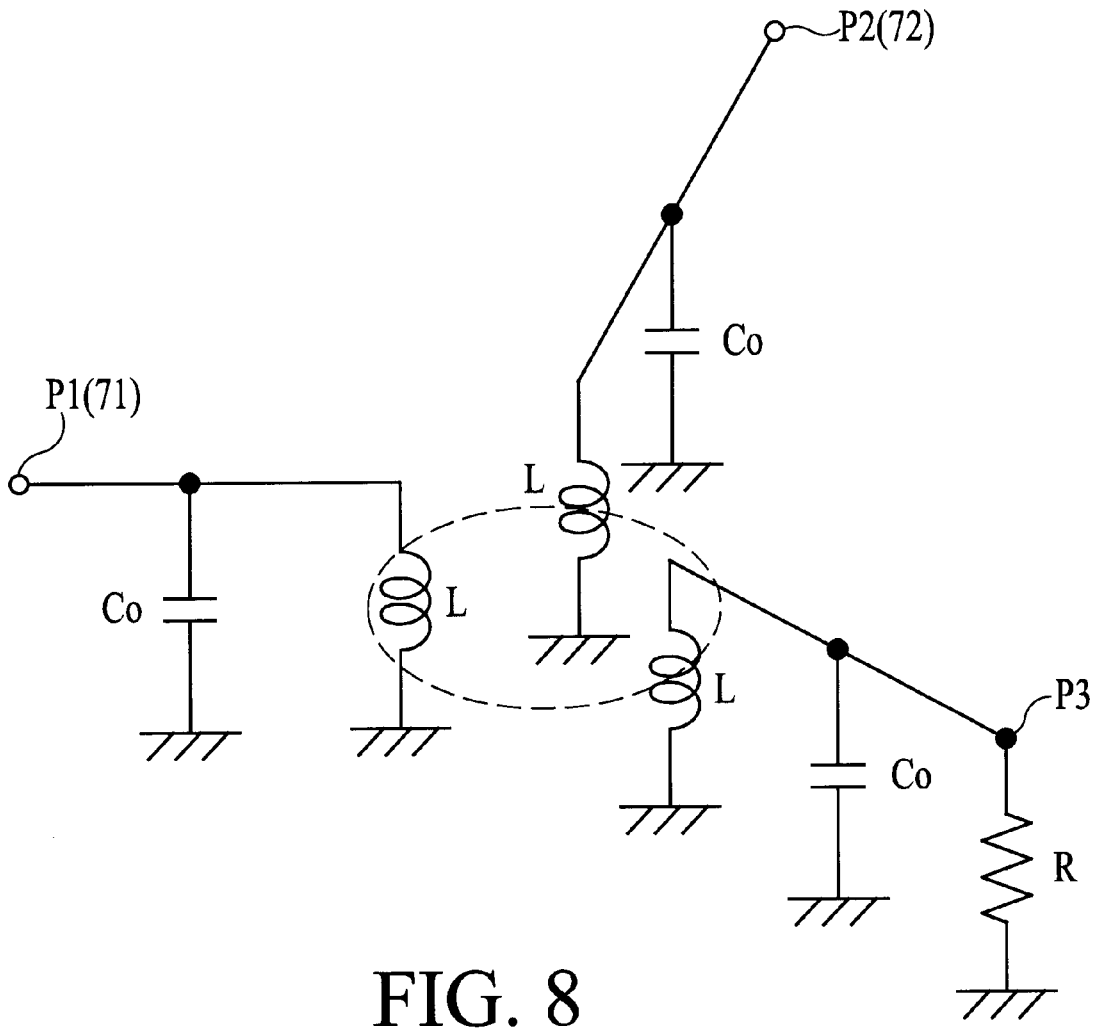
FIG. 8 PRIOR ART
FIG. 8 is an equivalent circuit diagram showing the conventional isolator.

FIG. 6 shows frequency characteristics of the isolator according to this embodiment and a conventional isolator, obtained when both are mounted on the mounting base-member. A solid line represents the characteristic obtained by this embodiment, and a broken line represents the characteristic obtained by the conventional isolator. As shown in FIG. 6, it is understood that the use of the isolator according to this embodiment provides attenuation significantly larger than that of the conventional isolator in a high-frequency band.

As described above, according to the isolator described in this embodiment, the inductors Lf are connected between the port P1 and the input/output terminal 71 and between the port P2 and the input/output terminal 72. In addition, when the isolator is mounted on the mounting base-member 10, in each signal-input/output portion is formed the low-pass filter LPF including the inductor Lf, the matching capacitor C1 (or C2), and the electrode-distribution capacitor Cp. Thus, as shown in FIG. 6, attenuation outside the pass band is significantly improved compared with that of the conventional isolator.

In other words, the isolator according to this embodiment has a built-in inductor providing a low-pass filter. By using the isolator according to this embodiment, unnecessary radiation can be reduced without using another conventionally required filter for preventing unnecessary radiation, which can provide a needed reduction in the size and the price of communication equipment.

In addition, the electrode-distribution capacitor Cp formed in the soldering lands 11*a* and 12*a* for the transmission lines 11 and 12 on the mounting base-member 10 is utilized for the low-pass filter LPF. Thus, complicated measures for avoiding disadvantageous influences caused by the electrode-distribution capacitor Cp, which are required in a conventional non-reciprocal circuit device, can be eliminated, and the soldering lands 11*a* and 12*a* can be used as areas on which mounting can be easily performed and sufficient mounting strength can be obtained. Accordingly, highly reliable mounting and mounting strength can be obtained.

By changing the value of the inductor Lf or the capacitor Cf, the input/output impedance of the isolator can be easily changed. In other words, without changing various types of components needed for setting the input/output impedance of the conventional isolator, by only changing the inductor Lf or the matching capacitors C1 and C2, conversion to a desired input/output impedance can be easily performed.

The above embodiment in which inductors Lf each providing a low-pass filter LPF are connected to both signal-input/output ports P1 and P2 of the isolator has been described. However, the present invention is not limited thereto. The above inductor Lf may be connected to either of the signal-input/output ports P1 and P2.

The above embodiment has described the isolator by way of example. The present invention may be applied to a circulator in which port P3 is used as a third input/output portion, without the terminal resistor R connected to the port P3.

Also the overall structure is not limited to that (shown in FIGS. 1 and 2) in the above embodiment, but may have a structure in which, for example, central conductors are formed in a multi-layer base-member.

The above embodiment in which a coil component is used as the inductor Lf has been described, but the formation of the inductor LF is not limited thereto. For example, the heads of the central conductors may be bent so as to have predetermined inductance. The input/output terminal may be formed so as to have predetermined inductance. If another component like a spacer member or the like is incorporated, an inductor electrode may be formed on the spacer member.

In short, the present invention is characterized in that an inductor included in a low-pass filter is connected between the port of a central conductor and a signal-input/output terminal in at least one signal-input/output portion.

What is claimed is:

1. In combination, an input/output transmission line and a non-reciprocal circuit device, said non-reciprocal circuit device comprising:

a plurality of central conductors arranged so as to mutually intersect; a magnetic substrate; said intersecting central conductors and said magnetic substrate being adapted to receive a d.c. magnetic field applied thereto;

at least one ground terminal;

a matching capacitor connected between a respective one of said central conductors and said at least one ground terminal; and an input/output terminal, and an inductor connected between said input/output terminal and at least one of said central conductors;

further comprising a mounting base-member; said input/output transmission line being disposed thereon;

wherein said input/output transmission line has an electrode-distribution capacitance;

wherein said input/output terminal is connected to said input/output transmission line;

wherein a low-pass filter is formed by said inductor, said electrode-distribution capacitance, and said matching capacitor connected to said input/output terminal; and wherein the value of said inductor or said matching capacitor is determined to obtain a desired input/output impedance of said non-reciprocal circuit device.

2. A non-reciprocal circuit device according to claim 1, wherein said desired input/output impedance corresponds to that of said input/output transmission line.

3. A non-reciprocal circuit device according to claim 1, further comprising a terminal resistance connected between another one of said central conductors and said at least one ground terminal.

4. A non-reciprocal circuit device according to claim 1, wherein the value of said matching capacitor comprises a component $C_o$ which provides said desired input/output impedance, and a component $C_f$ which is equal to the electrode-distribution capacitance $C_p$ of said input/output transmission line.

5. A non-reciprocal circuit device according to claim 1, further comprising an insulating case, said ground and input/output terminal being disposed on an external part of said case, and said central conductors, matching capacitor and inductor being disposed inside said case.

6. A non-reciprocal circuit device according to claim 2, wherein the value of said matching capacitor comprises a component $C_o$ which provides said desired input/output impedance, and a component $C_f$ which is equal to the electrode-distribution capacitance $C_p$ of said input/output transmission line.

7. In combination, a mounting base-member; a non-reciprocal circuit device mounted on said mounting base-member and an input/output transmission line on said mounting base-member; said non-reciprocal circuit device comprising:

a plurality of central conductors arranged so as to mutually intersect; a magnetic substrate; said intersecting central conductors and said magnetic substrate being adapted to receive a d.c. magnetic field applied thereto;

at least one ground terminal;

a matching capacitor connected between a respective one of said central conductors and said at least one ground terminal; and an input/output terminal, and an inductor connected between said input/output terminal and at least one of said central conductors;

wherein said input/output transmission line has an electrode-distribution capacitance;

wherein said input/output terminal is connected to said input/output transmission line;

wherein a low-pass filter is formed by said inductor, said electrode-distribution capacitance, and said matching capacitor connected to said input/output terminal; and wherein the value of said inductor or said matching capacitor is determined to obtain a desired input/output impedance of said non-reciprocal circuit device.

8. A non-reciprocal circuit device according to claim 7, wherein said desired input/output impedance corresponds to that of said input/output transmission line.

9. A non-reciprocal circuit device according to claim 2, wherein the value of said matching capacitor comprises a component $C_o$ which provides said desired input/output impedance, and a component $C_f$ which is equal to the electrode-distribution capacitance $C_p$ of said input/output transmission line.

10. A non-reciprocal circuit device according to claim 7, further comprising an insulating case, said ground and input/output terminal being disposed on an external part of said case, and said central conductors, matching capacitor and inductor being disposed inside said case.

11. A non-reciprocal circuit device according to claim 8, wherein the value of said matching capacitor comprises a component $C_o$ which provides said desired input/output impedance, and a component $C_f$ which is equal to the electrode-distribution capacitance $C_p$ of said input/output transmission line.

12. A method of setting a desired impedance in a non-reciprocal circuit device, comprising the steps of:

arranging a plurality of mutually intersecting central conductors and a magnetic substrate so that said central conductors and said magnetic substrate are adapted to receive a d.c. magnetic field applied thereto;

providing at least one ground terminal;

connecting a matching capacitor between a respective one of said central conductors and said at least one ground terminal; and connecting an input/output terminal via an inductor to at least one of said central conductors;

mounting said non-reciprocal circuit device on a mounting base-member;

connecting an input/output transmission line on said mounting base-member to said input/output terminal;

thereby forming for said input/output terminal a low-pass filter formed by said inductor, said matching capacitor, and an electrode-distribution capacitance of said input/output transmission line corresponding thereto; and adjusting for said input/output terminal a value of said inductor or said matching capacitor corresponding thereto, to obtain a desired input/output impedance at the corresponding said input/output terminal.

13. A method as in claim 12, wherein only said inductor value is adjusted in said adjusting step.

14. A method as in claim 12, wherein only said matching capacitor value is adjusted in said adjusting step.

15. A method as in claim 12, wherein both said matching capacitor and inductor values are adjusted in said adjusting step.

16. A method as in claim 12, wherein values of both said matching capacitor and said electrode-distribution capacitor are adjusted in said adjusting step.

17. A method as in claim 12, wherein the value of said matching capacitor is set in said adjusting step to correspond to the sum of a component $C_o$ which provides said desired input/output impedance, and a component $C_f$ which is equal to the electrode-distribution capacitance $C_p$ of said input/output transmission line.

* * * * *